US009644361B2

(12) United States Patent
Nakamura et al.

(10) Patent No.: US 9,644,361 B2
(45) Date of Patent: May 9, 2017

(54) SANITARY WASHING APPARATUS

(71) Applicant: TOTO LTD., Kitakyushu-shi, Fukuoka (JP)

(72) Inventors: Hiroshi Nakamura, Fukuoka-ken (JP); Nozomu Okada, Fukuoka-ken (JP); Tomohiro Noguchi, Fukuoka-ken (JP); Shintaro Fukuzato, Fukuoka-ken (JP); Minoru Matsui, Fukuoka-ken (JP)

(73) Assignee: TOTO LTD, Kitakyushu-Shi, Fukuoka (JP)

( * ) Notice: Subject to any disclaimer, the term of this patent is extended or adjusted under 35 U.S.C. 154(b) by 96 days.

(21) Appl. No.: 14/345,476

(22) PCT Filed: Oct. 26, 2012

(86) PCT No.: PCT/JP2012/077769
§ 371 (c)(1),
(2) Date: Mar. 18, 2014

(87) PCT Pub. No.: WO2013/062097
PCT Pub. Date: May 2, 2013

(65) Prior Publication Data

US 2014/0352049 A1 Dec. 4, 2014

(30) Foreign Application Priority Data

Oct. 28, 2011 (JP) ..... 2011-237566

(51) Int. Cl.
*E03D 9/08* (2006.01)

(52) U.S. Cl.
CPC ..... *E03D 9/08* (2013.01)

(58) Field of Classification Search
CPC ..... E03D 9/08
See application file for complete search history.

(56) References Cited

U.S. PATENT DOCUMENTS 4,136,407 A * 1/1979 Maurer ..... E03D 9/08 4/448
2005/0246828 A1* 11/2005 Shirai ..... E03D 9/08 4/420.4

* cited by examiner

*Primary Examiner* — Janie Loeppke
(74) *Attorney, Agent, or Firm* — Pearne & Gordon LLP

(57) ABSTRACT

The sanitary washing apparatus according to the invention comprises a cylinder, and a piston slider including a squirting port in a front end part and a second inflow port in a rear end part and internally including a flow channel connecting the squirting port with the second inflow port, The cylinder includes biasing means configured to reciprocably house the piston slider and to bias the piston slider backward, The rear end part of the piston slider includes a water pressure receiving part configured to receive water pressure of water flowing into the cylinder, and Pressure of water flowing from the first inflow port into the cylinder is received by the water pressure receiving part of the piston slider so that the piston slider is advanced to a use position against biasing force of the biasing means.

An object of the invention is to provide a sanitary washing apparatus capable of suppressing jetting of water from the squirting port during the advance of the hydraulic nozzle based on a simple configuration, and also capable of maintaining a clean state after use of the nozzle without leaving water in its flow channel.

6 Claims, 6 Drawing Sheets

SANITARY WASHING APPARATUS

TECHNICAL FIELD

This invention relates to a sanitary washing apparatus, and more particularly to a sanitary washing apparatus for washing the private parts of a person seated on a toilet seat with water squirted from a washing nozzle.

BACKGROUND ART

Conventionally, what is called the "hydraulic nozzle" is well known as a nozzle used in a sanitary washing apparatus. The hydraulic nozzle includes a piston slider including a squirting port at its tip. The piston slider is biased backward by a spring force and housed in a cylinder. The piston slider is advanced by the pressure of water poured into the cylinder.

However, the sanitary washing apparatus as described above has the following problem. While pouring water into the cylinder to advance the piston slider to a prescribed use position, the water may be squirted from the squirting port of the piston slider.

Thus, in order to solve the problem as described above, for instance, a sanitary washing apparatus disclosed in Japanese Patent Unexamined Publication No. 7-62710 has been proposed (Patent Literature 1). The sanitary washing apparatus disclosed in Japanese Patent Unexamined Publication No. 7-62710 includes a slide plug for occluding the inflow port in the rear end part of the piston slider by the pressure of water flowing into the cylinder during the advance of the piston slider, a guide bar for guiding the slider plug, and a stopper for stopping the slider plug. Thus, the slider plug occludes the inflow port of the piston slider until the slide plug stops at the stopper during the advance of the piston slider. When the slide plug stops at the stopper and the piston slider advances forward, its inflow port is opened.

Thus, no water flows into the inflow port of the piston slider until the piston slider reaches a prescribed position during the advance of the piston slider. Accordingly, no water is unexpectedly squirted from the squirting port of the piston slider.

CITATION LIST

Patent Literature

[Patent Citation 1] JP H07-62710 A (Kokai)

SUMMARY OF INVENTION

Problems to Be Solved by the Invention

However, in the sanitary washing apparatus disclosed in Japanese Patent Unexamined Publication No. 7-62710, the slide plug occludes the inflow port of the piston slider even when the piston slider is retracted. Thus, the water left in the flow channel of the piston slider is not drained from the flow channel, but retained there for a long time. In such a sanitary washing apparatus, long-term retention of water in the flow channel of the piston slider may cause multiplication of bacteria in the flow channel. Furthermore, in the case of a sanitary washing apparatus capable of squirting warm water, cold water may be squirted in the early phase of the washing operation. This may cause discomfort to the user.

This invention has been made to solve the aforementioned problems in the conventional art. An object of the invention is to provide a sanitary washing apparatus capable of suppressing jetting of water from the squirting port during the advance of the hydraulic nozzle based on a simple configuration, and also capable of maintaining a clean state after use of the nozzle without leaving water in its flow channel.

Means for Solving the Problem

An aspect of the invention provides a sanitary washing apparatus configured to squirt water supplied from a water supply source to a human body, comprising a cylinder including a first inflow port in a rear end part, and a piston slider including a squirting port in a front end part and a second inflow port in a rear end part and internally including a flow channel connecting the squirting port with the second inflow port. The cylinder includes biasing means configured to reciprocably house the piston slider and to bias the piston slider backward. The rear end part of the piston slider includes a water pressure receiving part configured to receive water pressure of water flowing into the cylinder, and jetting suppression means configured to suppress jetting of water from the squirting port. Pressure of water flowing from the first inflow port into the cylinder is received by the water pressure receiving part of the piston slider so that the piston slider is advanced to a use position against biasing force of the biasing means. The apparatus further includes a communication channel configured to cause part of the flow channel of the piston slider to permanently communicate with space in the cylinder. The communication channel avoids decreasing pressure of water in the cylinder in a process of advancing the piston slider.

DESCRIPTION OF EMBODIMENTS

Figure 1:
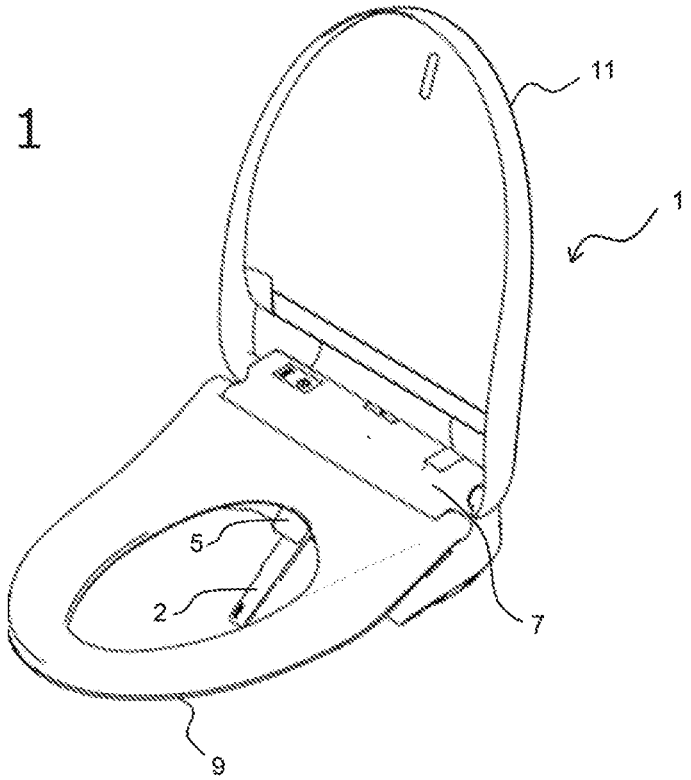
FIG. 1 is a perspective view showing an example of the sanitary washing apparatus according to the invention.

In order to achieve the aforementioned object, the invention adopts the following means. That is, the sanitary washing apparatus according to the invention is a sanitary washing apparatus configured to squirt water supplied from a water supply source to a human body, comprising a cylinder including a first inflow port in a rear end part, and a piston slider including a squirting port in a front end part and a second inflow port in a rear end part and internally including a flow channel connecting the squirting port with the second inflow port. The cylinder includes biasing means configured to reciprocably house the piston slider and to bias the piston slider backward. The rear end part of the piston slider includes a water pressure receiving part configured to receive water pressure of water flowing into the cylinder, and jetting suppression means configured to suppress jetting of water from the squirting port. Pressure of water flowing from the first inflow port into the cylinder is received by the water pressure receiving part of the piston slider so that the piston slider is advanced to a use position against biasing force of the biasing means. The apparatus further includes a communication channel configured to cause part of the flow channel of the piston slider to permanently communicate with space in the cylinder. The communication channel avoids decreasing pressure of water in the cylinder in a process of advancing the piston slider.

In the invention thus configured, part of the flow channel of the piston slider permanently communicates with the space in the cylinder through the communication channel. Thus, after completion of human body washing by the piston slider, air in the cylinder goes into the flow channel through the communication channel. Accordingly, the water left in the flow channel is replaced by the air and drained from the squirting port. Thus, the water is not left for a long time in the flow channel of the piston slider. Accordingly, a clean state can be maintained.

Furthermore, the communication channel is configured so as to avoid decreasing the pressure of water in the cylinder in the process of advancing the piston slider. Thus, the advancing movement of the piston slider is not hampered, and the operation of human body washing can be smoothly performed.

Preferably, the invention is characterized in that the communication channel is formed so as to be generally perpendicular to axial direction of the cylinder.

In the invention thus configured, even when water is poured into the cylinder in the process of advancing the piston slider, and water pressure is applied in the axial direction of the cylinder (the advancing direction of the piston slider), the water does not easily go into the communication channel formed so as to be generally perpendicular to the water pressure direction. Thus, jetting of water from the squirting port in the process of advancing the piston slider can be suppressed more reliably.

Preferably, the invention is characterized in that opening of the communication channel faces above the space in the cylinder.

In the invention thus configured, in the process in which the water in the cylinder is drained and the cylinder is gradually filled with air during or after the retracting of the piston slider, the communication channel of the piston slider rapidly communicates with the air in the cylinder. Thus, the water in the flow channel is rapidly drained.

Embodiments of the invention will now be described in detail with reference to the drawings.

The drawings are schematic or conceptual. The shape and the relationship between the vertical and horizontal dimensions of each portion, and the size ratio between the portions, for instance, are not necessarily identical to those in reality. Furthermore, the same portion may be shown with different dimensions or ratios depending on the figures.

In the present description and the drawings, components similar to those described with reference to earlier figures are labeled with like reference numerals, and the detailed description thereof is omitted appropriately.

FIG. 1 is a perspective view showing an example of the sanitary washing apparatus based on the invention.

As shown in FIG. 1, the sanitary washing apparatus 1 according to an embodiment of the invention includes a nozzle device 2 for washing a human body, a casing 7 for housing this nozzle device 2 therein, a toilet seat 9 pivotally supported on the casing 7 in a rotatable manner, and a toilet lid 11 for covering the top of the toilet seat 9. An opening (not shown) for advancing and retracting the nozzle device 2 is formed in the casing 7. A nozzle shutter 5 for opening and closing the opening is provided thereon.

The casing 7 includes therein a valve unit (not shown) for switching supply and stoppage of water supplied to the nozzle device 2, and a heat exchange unit (not shown) interposed between the valve unit and the nozzle device 2 and configured to warm water to a prescribed temperature.

Next, the nozzle device 2 according to the embodiment of the invention is described with reference to FIG. 2.

In the nozzle device 2, a piston slider 6 shaped like a hollow bar is housed in a cylinder 4 so as to be reciprocable in the front-rear direction. The piston slider 6 includes a squirting port 14 for squirting water in its tip part. When the piston slider 6 is projected forward, the piston slider 6 is projected from a cylinder opening 13 formed in the front end part of the cylinder 4. Furthermore, the cylinder 4 includes a water supply port 8 in its rear end part. The cylinder 4 is supplied with water from a water supply source, not shown, through the valve unit, the heat exchange unit and the like. Furthermore, an attachment part 3 for attachment to a case plate, not shown, is provided below the cylinder 4.

Figure 2:
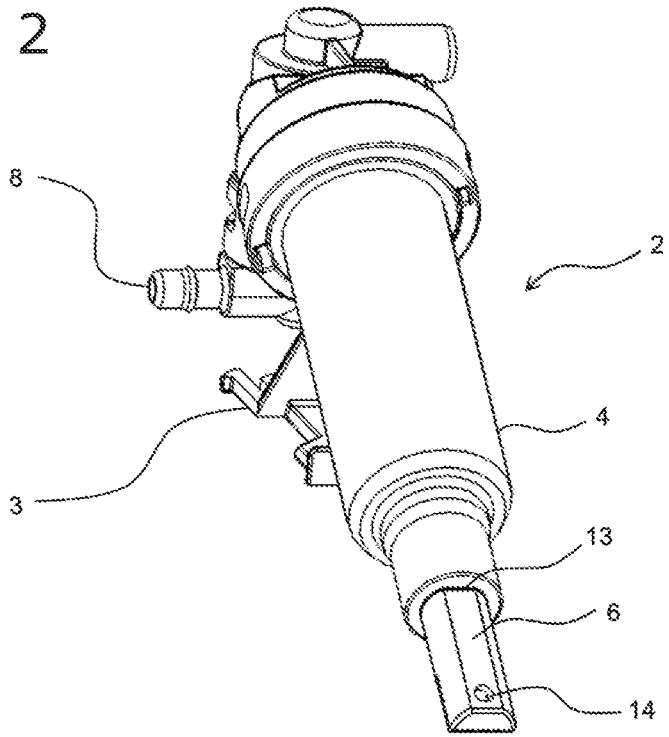
FIG. 2 is an appearance perspective view showing a nozzle device of FIG. 1.
Figure 3:
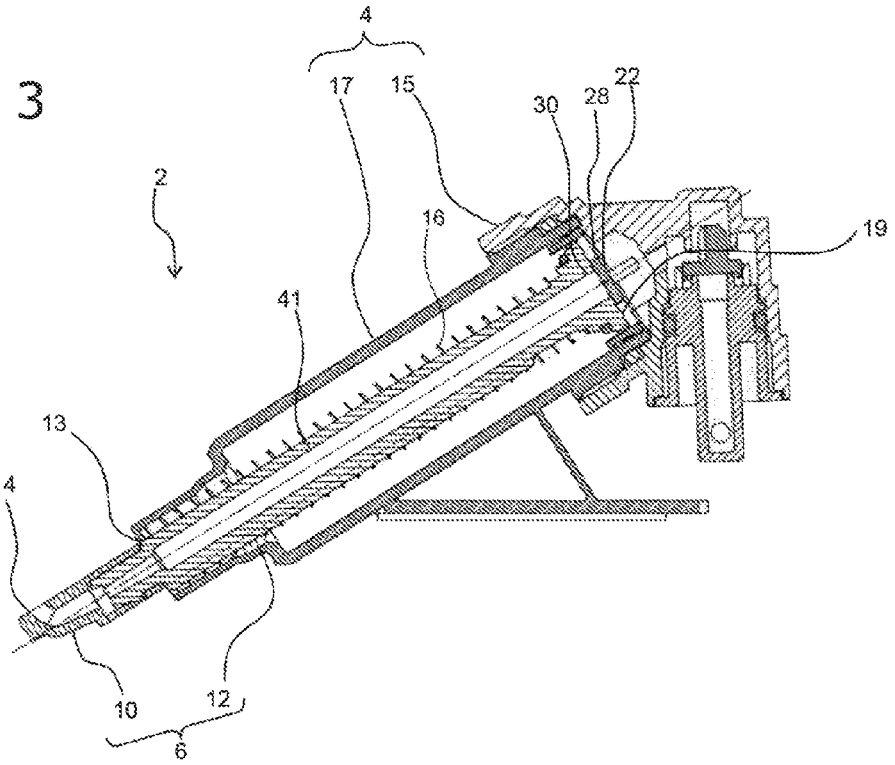
FIG. 3 is a sectional view of the nozzle device of FIG. 2.

FIG. 3 is a sectional view of the nozzle device of FIG. 2, showing the internal structure of the cylinder 4.

As shown in FIG. 3, the cylinder 4 is composed of a tubular member 17 and a lid member 15 for occluding the rear end opening of the tubular member 17. The piston slider 6 housed in the cylinder 4 is split into a front slider 10 including a squirting port 14, and a rear slider 12 including an inflow port 30. The front slider 10 and the rear slider 12 are detachably fitted together. A flow channel 41 connecting from the inflow port 30 to the squirting port 14 is provided inside this piston slider 6.

A spring 16 for biasing the piston slider 6 backward is further provided in the cylinder 4. A plate-like water pressure receiving part 19 for receiving the pressure of water flowing into the cylinder 4 is provided around the inflow port 30 of the rear slider 12. This water pressure receiving part 19 is configured to receive the pressure of water flowing into the cylinder 4 so that the piston slider 6 is advanced forward against the biasing force of the spring 16.

Furthermore, a plate-like jetting suppression member 22 abutting on the water pressure receiving part 19 of the rear slider 12 and stopping the inflow port 30 from the rear side is provided in the cylinder 4. The jetting suppression member 22 is configured to suppress inflow of water into the inflow port 30 during the advance of the piston slider 6. The operation of this jetting suppression member 22 is described below in detail.

Figure 4:
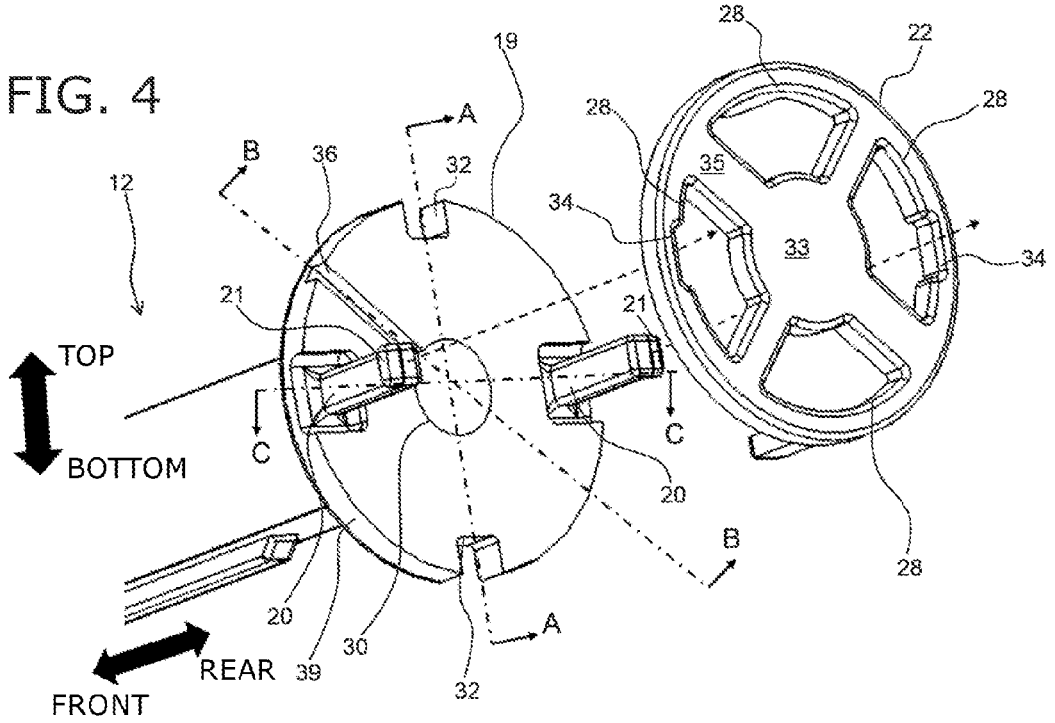
FIG. 4 is a perspective view of a water pressure receiving part and a jetting suppression member.
Figure 5:
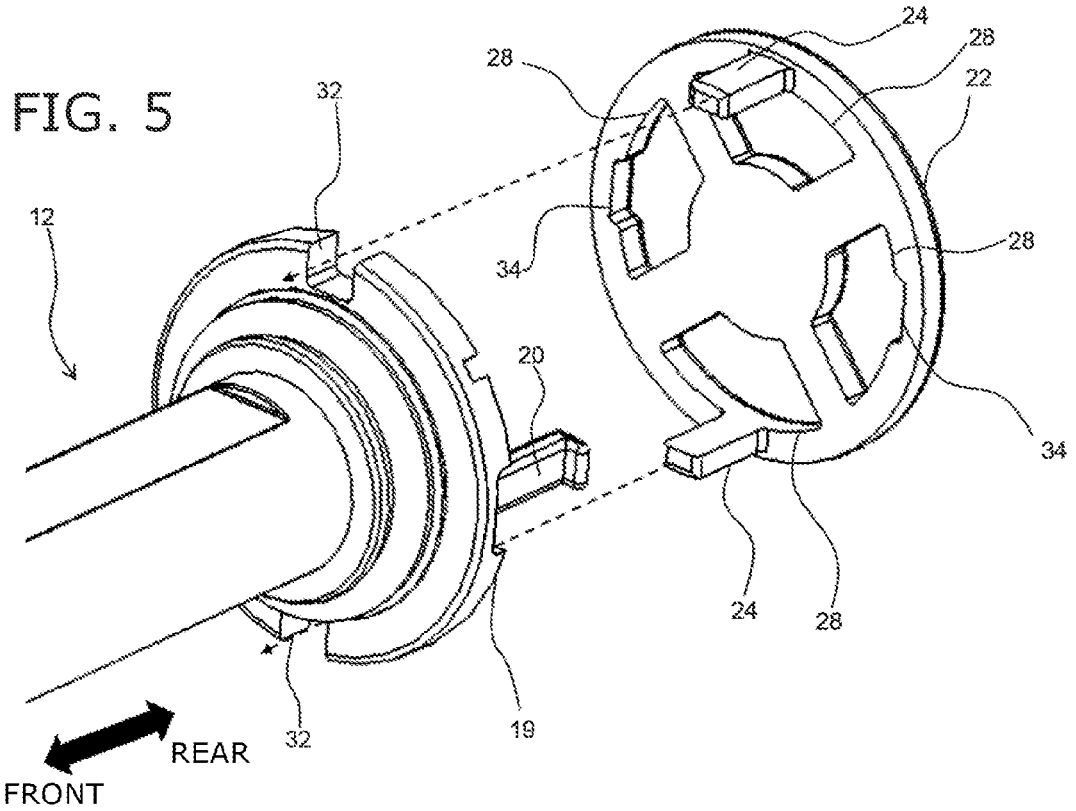
FIG. 5 is a perspective view as viewed from an angle different from FIG. 4.

Next, the detailed structure of the rear end part of the rear slider 12 and the jetting suppression member 22 is described with reference to FIGS. 4 and 5. FIGS. 4 and 5 are enlarged perspective views showing the rear end part of the rear slider 12 and the jetting suppression member 22. FIG. 4 is a figure of the rear slider 12 and the jetting suppression member 22 as viewed from the rear side. FIG. 5 is a figure thereof as viewed from the front side.

As shown in FIG. 4, the rear end part of the rear slider 12 includes a plate-like water pressure receiving part 19. An inflow port 30 is formed at the center thereof. The water pressure receiving part 19 includes a communication recess 36 extending from the inflow port 30 to the outside surface 39 of the water pressure receiving part 19. Furthermore, the water pressure receiving part 19 includes locking hooks 20 at two sites. The locking hook 20 has a lug part 21 at its tip and extends backward. Furthermore, a first recess 32 is provided at the outside surface 39 of the water pressure receiving part.

On the other hand, the jetting suppression member 22 includes an inflow port stopping part 33 for stopping the inflow port 30 of the rear slider 12 from the rear side, and a communication recess stopping part 35 for stopping the communication recess 36 from the rear side. Furthermore, openings 38 are provided at four sites on the top, bottom, left, and right of the jetting suppression member 22. A second recess 34 recessed toward the outer periphery is provided in the opening 28 on the left and right of the jetting suppression member 22. The second recess 34 is configured so that the locking hook 20 of the rear slider 12 is slidable along the second recess 34 after attachment of the jetting suppression member 22. Here, the lug part 21 is formed at the tip of the locking hook 20. Thus, the jetting suppression member 22 is not spontaneously detached.

Furthermore, as shown in FIG. 5, the jetting suppression member 22 includes a bar-like spacing member 24 so as to extend forward. The spacing member 24 is configured so as to be slidable along the first recess 32 of the rear slider 12 after the jetting suppression member 22 is attached to the rear end part of the rear slider 12.

Figure 6:
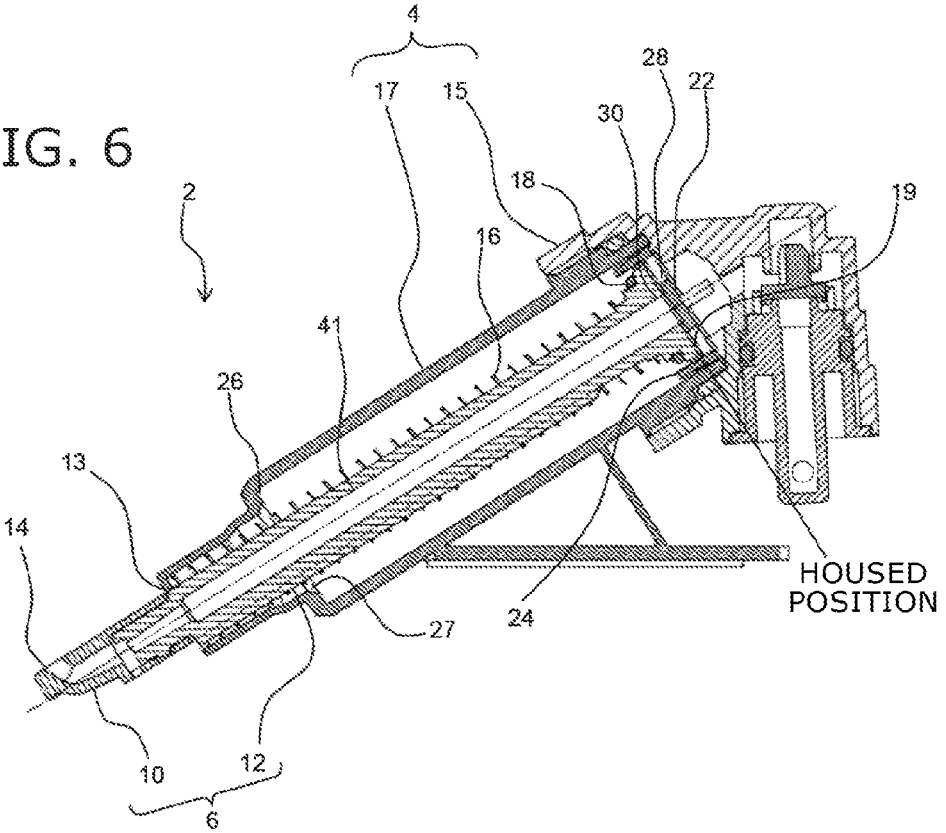
FIG. 6 is an A-A cross sectional view of FIG. 4 at the time when the piston slider is located at a housed position.
Figure 7:
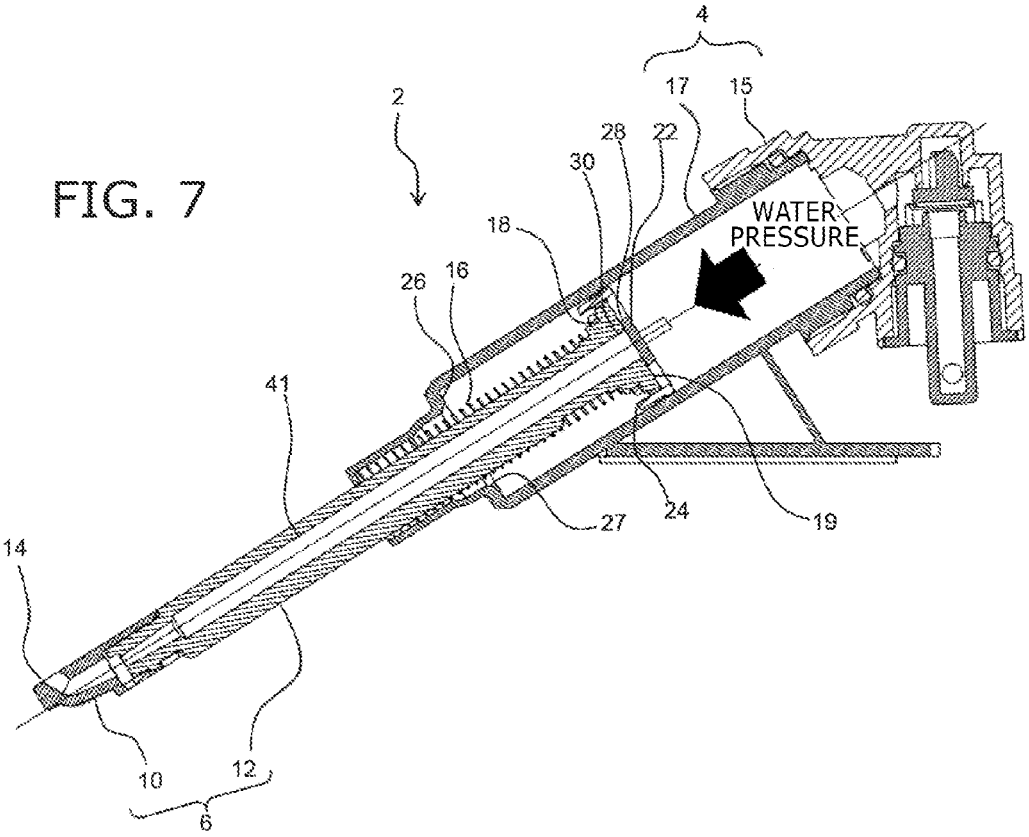
FIG. 7 is an A-A cross sectional view of FIG. 4 at the time when the piston slider is located at an advancing position.
Figure 8:
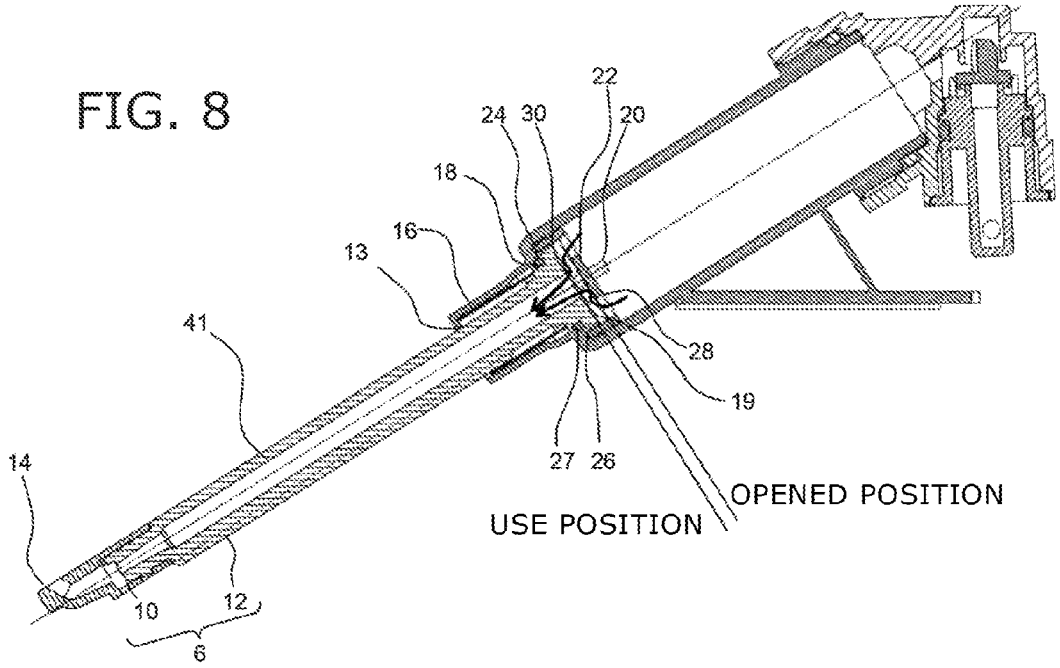
FIG. 8 is an A-A cross sectional view of FIG. 4 at the time when the piston slider is located at a use position.
Figure 9:
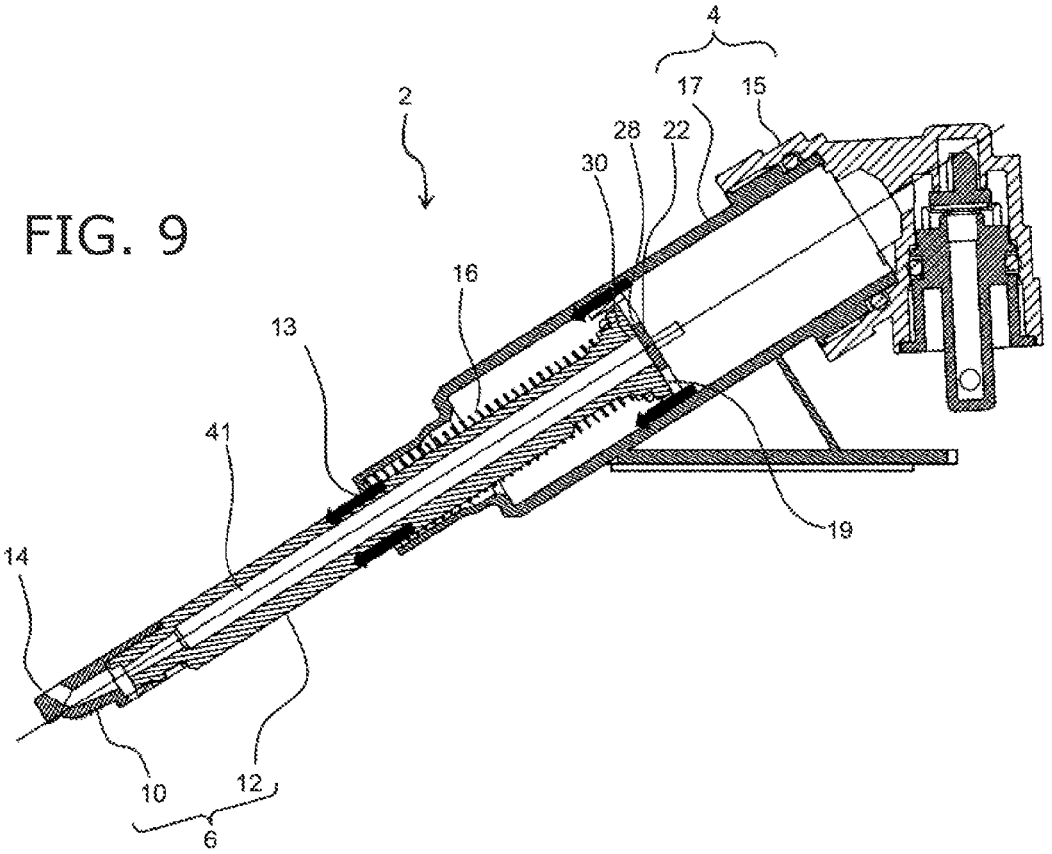
FIG. 9 is an A-A cross sectional view of FIG. 4 at the time when the piston slider is located at a retracting position.

Next, the operation of the nozzle device of this embodiment is described with reference to FIGS. 6, 7, 8, and 9. FIG. 6 is a sectional view at the time when the piston slider 6 is located at a housed position. FIG. 7 is a sectional view at the time when the piston slider 6 is located at an advancing position. FIG. 8 is a sectional view at the time when the piston slider 6 is located at a use position. FIG. 9 is a sectional view at the time when the piston slider 6 is located at a retracting position. These sectional views are shown with reference to the A-A cross section of the piston slider 6 shown in FIG. 4.

The line of "housed position" shown in FIG. 6 is a line with reference to the position of the rear end surface of the piston slider 6 at the time when the piston slider 6 is located at a housed position. The lines of "opened position" and "use position" shown in FIG. 8 are also lines with reference to the position of the rear end surface of the piston slider 6. FIG. 6 is a figure in the same state as FIG. 3. The description of the portions with like reference numerals is omitted.

As shown in FIG. 6, the tubular member 17 of the cylinder 4 includes a step part 27 and a seal surface 26 near the cylinder opening 13. An O-ring 18 made of rubber or the like is attached to the front side of the water pressure receiving part 19 of the piston slider 6.

Even when the piston slider 6 is located at the housed position, a certain space is provided behind the piston slider 6 in the cylinder 4. This space is supplied with water from a water supply port, not shown. The water pressure thereof is received by the water pressure receiving part 19 of the piston slider 6 and the jetting suppression member 22. Thus, the piston slider 6 starts to advance against the biasing force of the spring 16.

As shown in FIG. 7, during the advance of the piston slider 6, the jetting suppression member 22 stops the inflow port 30 of the piston slider 6 from the rear side by the pressure of water flowing into the cylinder 4. This can suppress that the water in the cylinder 4 flows into the flow channel 41 of the piston slider 6. Thus, jetting of water from the squirting port 14 of the piston slider 6 can be suppressed.

After the state shown in FIG. 7, the piston slider 6 further advances. Then, the front end of the spacing member 24 of the jetting suppression member 22 abuts on the step part 27 of the cylinder 4. This stops the movement of the jetting suppression member. (At this time, the piston slider 6 is located at the "opened position" of FIG. 8.) Also thereafter, the pressure of water is applied to the water pressure receiving part 19 of the piston slider 6 through the opening 28 of the jetting suppression member 22. Thus, the piston slider 6 continues to advance. When the piston slider 6 reaches the "use position" shown in FIG. 8, the O-ring 18 of the piston slider 6 abuts on the seal surface 26 of the cylinder 4. Thus, the piston slider 6 stops.

At this time, as shown in FIG. 8, the inflow port 30 of the piston slider 6 is opened, and water flows in through the opening 28 of the jetting suppression member 22 (arrow in FIG. 8). The water poured into the inflow port 30 flows in the flow channel 41 inside the piston slider 6 and is squirted from the squirting port 14.

Furthermore, at this time, the O-ring 18 of the piston slider 6 seals the position between the outer peripheral surface of the piston slider 6 and the inner wall surface of the cylinder 4. Thus, no water flows out through the gap between the outer peripheral surface of the piston slider 6 and the cylinder opening 13. Accordingly, the force of water squirted from the squirting port 14 of the piston slider 6 is not decreased.

Then, when supply of water into the cylinder 4 is stopped, the pressure of water ceases to be applied to the water pressure receiving part 19 of the piston slider 6. Thus, the piston slider 6 starts to retract by the biasing force of the spring 16.

Then, as shown in FIG. 9, during the retracting of the piston slider 6, the water accumulated on the rear side of the piston slider 6 in the cylinder 4 flows to the front side of the water pressure receiving part 19 through the gap between the outer peripheral surface of the water pressure receiving part 19 and the inner wall surface of the cylinder 4. Then, the water is drained to the outside of the cylinder 4 through the gap between the outer peripheral surface of the piston slider 6 and the cylinder opening 13. Thus, the piston slider 6 is retracted by the biasing force of the spring 16. Simultaneously, the water in the cylinder 4 is drained to the outside. Thus, the piston slider 6 ultimately returns to the housed position of FIG. 6.

In particular, when the piston slider 6 is in the course of retracting or located at the housed position as described above, the inflow port 30 of the piston slider 6 is stopped by the jetting suppression member 22. Thus, water may remain in the flow channel 41 thereof. However, the nozzle device 2 of this embodiment solves it by the communication channel described below.

The communication channel of the nozzle device of this embodiment is described with reference to FIG. 10.

Figure 10:
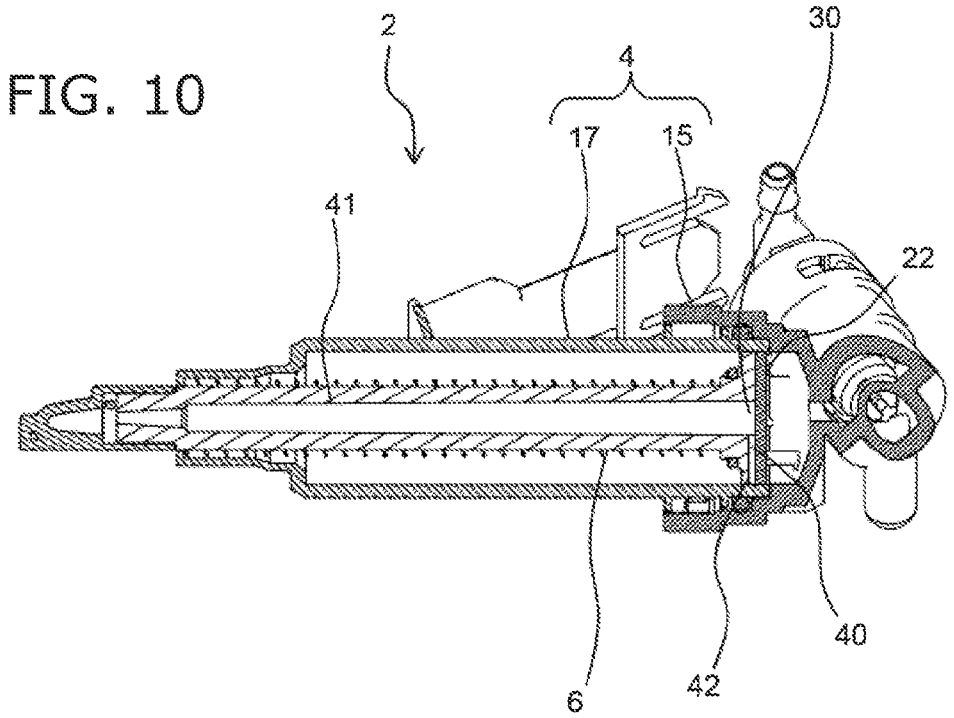
FIG. 10 is a B-B cross sectional view of FIG. 4.

FIG. 10 is a sectional view with reference to the B-B cross section of FIG. 4, also showing the cylinder and the jetting suppression member in conjunction therewith.

As shown in FIG. 10, even when the inflow port 30 of the piston slider 6 is stopped by the jetting suppression member 22 from the rear side, a communication channel 40 (composed of the communication recess 36 and the communication recess stopping part 35 described above) is formed in the rear end part of the piston slider 6. Thus, the inflow port 30 permanently communicates with the space in the cylinder 4. Accordingly, for instance, when the piston slider 6 returns to the housed position after human body washing, even if the jetting suppression member 22 stops the inflow port 30 from the rear side, air can be taken into the flow channel 41 of the piston slider 6 through the communication channel 40. Thus, the water in the flow channel 41 can be drained to the outside.

The communication channel 40 of this embodiment is formed so as to be generally perpendicular to the axial direction of the cylinder 4. Thus, in the process of pouring water into the cylinder 4 to advance the piston slider 6, the direction of the communication channel 40 can be made orthogonal to the applying direction of the pressure of water. This makes the pressure of water less likely to be applied to the communication channel 40. Thus, the pressure of water in the cylinder 4 is not decreased in the process of advancing the piston slider 6. Accordingly, the advancing movement of the piston slider 6 is not hampered.

Furthermore, the opening 42 of the communication channel 40 of this embodiment is formed so as to face above the space in the cylinder 4. Accordingly, in the process in which the water in the cylinder 4 is drained and the cylinder 4 is gradually filled with air during or after the retracting of the piston slider 6, the communication channel 40 of the piston slider 6 rapidly communicates with the air in the cylinder 4. Thus, the water in the flow channel 41 is rapidly drained.

Next, the locking hook of the nozzle device of this embodiment is described with reference to FIG. 11.

Figure 11:
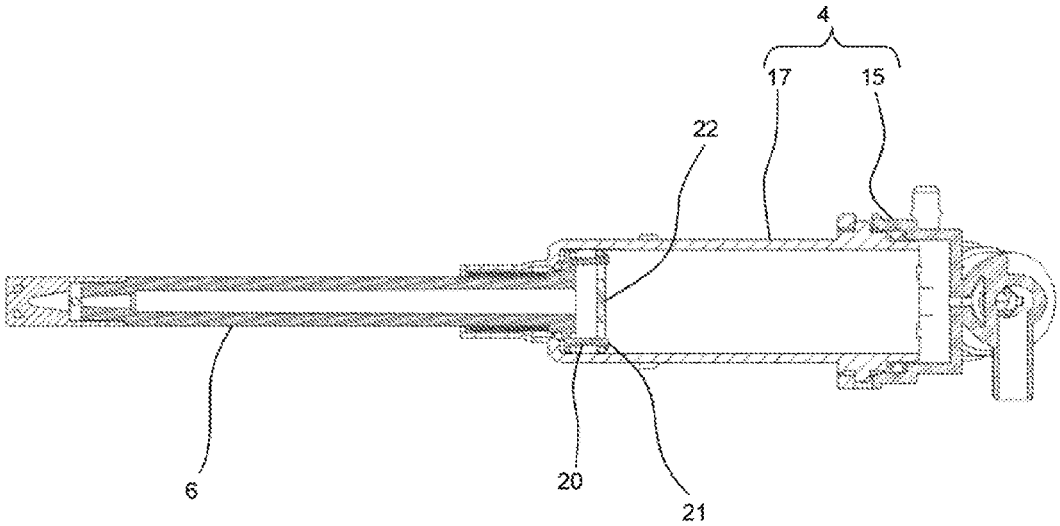
FIG. 11 is a C-C cross sectional view of FIG. 4.

FIG. 11 is a sectional view with reference to the B-B cross section of FIG. 4, also showing the cylinder and the jetting suppression member in conjunction therewith.

As shown in FIG. 11, a locking hook 20 having a lug part 21 at its tip is provided in the rear end part of the piston slider 6. The locking hook 20 is configured so that the jetting suppression member 22 is not separated beyond a prescribed distance from the piston slider 6.

When the user performs cleaning and the like, the user may force to advance the piston slider 6 by pulling the tip of the piston slider 6 by hand. However, the jetting suppression member 22 is not separated beyond a prescribed distance from the piston slider 6. This avoids the malfunction of stopping of the jetting suppression member 22 due to e.g. rotation of the jetting suppression member 22 in the cylinder 4.

The nozzle device in this embodiment has been described above with reference to the drawings. However, the invention is not limited thereto, but the embodiment can be appropriately designed without departing from the spirit of the invention. For instance, in this embodiment, the communication channel 40 is provided at only one site. However, the communication channel 40 may be provided at a plurality of sites. Furthermore, the communication recess 36 constituting the communication channel 40 is provided on the piston slider 6 side. However, the communication recess 36 may be provided on the jetting suppression member 22 side.

INDUSTRIAL APPLICABILITY

The aspects of the invention provide a sanitary washing apparatus capable of suppressing jetting of water from the squirting port during the advance of the hydraulic nozzle based on a simple configuration, and also capable of maintaining a clean state after use of the nozzle without leaving water in its flow channel.

REFERENCE SIGNS LIST

1 sanitary washing apparatus
2 nozzle device
3 attachment part
4 cylinder
5 nozzle shutter
6 piston slider
7 casing
8 water supply port
9 toilet seat
10 front slider
11 toilet lid
12 rear slider
13 cylinder opening
14 squirting port
15 lid member
16 spring
17 tubular member
18 O-ring
19 water pressure receiving part
20 locking hook
21 lug part
22 jetting suppression member
24 spacing member
28 opening
30 inflow port
32 first recess
33 inflow port stopping part
34 second recess
35 communication recess stopping part
36 communication recess
39 outside surface
40 communication channel
41 flow channel
42 opening of communication channel

The invention claimed is:

1. A sanitary washing apparatus configured to squirt water supplied from a water supply source to a human body, comprising:

a cylinder including a first inflow port in a rear end part; and a piston slider including a squirting port squirting the water to the human body in a front end part and a second inflow port in a rear end part and internally including a flow channel connecting the squirting port with the second inflow port, the cylinder including biasing means configured to reciprocably house the piston slider and to bias the piston slider backward, the rear end part of the piston slider including a water pressure receiving part configured to receive water pressure of water flowing into the cylinder, and jetting suppression means configured to suppress jetting of water from the squirting port, pressure of water flowing from the first inflow port into the cylinder being received by the water pressure receiving part of the piston slider so that the piston slider is advanced to a use position against biasing force of the biasing means, the apparatus further including a communication channel permanently communicating a part of the flow channel of the piston slider with a space in the cylinder both in a housed position and in the use position, the communication channel avoiding decreasing pressure of water in the cylinder in a process of advancing the piston slider, and the water flowing in the cylinder and the piston slider through the first inflow port squirting only from the squirting port in the use position, the second inflow port of the piston slider being stopped by the jetting suppression means when the piston slider is in the course of retracting or located at the housed position.

2. The apparatus according to claim 1, wherein the communication channel is formed so as to be generally perpendicular to axial direction of the cylinder.

3. The apparatus according to claim 1, wherein opening of the communication channel faces above the space in the cylinder.

4. The apparatus according to claim 2, wherein opening of the communication channel faces above the space in the cylinder.

5. The apparatus according to claim 1, wherein the communication channel extends from the second inflow port to an outside surface of the water pressure receiving part.

6. The apparatus according to claim 1, wherein the cylinder and the piston slider tilt toward under so that the squirting port is located lower than the first inflow port, and the cylinder and the piston slider take air into the flow channel through the communication channel and drain the water in the flow channel from the squirting port in the housed position.

* * * * *